US009121334B2

(12) United States Patent
Honda et al.

(10) Patent No.: US 9,121,334 B2
(45) Date of Patent: Sep. 1, 2015

(54) OIL JET

(71) Applicants: Akihiro Honda, Toyota (JP); Motoichi Murakami, Toyota (JP); Masahiro Kawahara, Toyota (JP); Yoshitaka Yamaguchi, Toyota (JP)

(72) Inventors: Akihiro Honda, Toyota (JP); Motoichi Murakami, Toyota (JP); Masahiro Kawahara, Toyota (JP); Yoshitaka Yamaguchi, Toyota (JP)

(73) Assignees: TOYOTA JIDOSHA KABUSHIKI KAISHA, Toyota-shi (JP); TAIHO KOGYO CO., LTD., Toyota-shi (JP)

( * ) Notice: Subject to any disclaimer, the term of this patent is extended or adjusted under 35 U.S.C. 154(b) by 0 days.

(21) Appl. No.: 14/343,280

(22) PCT Filed: Feb. 22, 2013

(86) PCT No.: PCT/JP2013/054495

§ 371 (c)(1),
(2) Date: Mar. 6, 2014

(87) PCT Pub. No.: WO2013/150827

PCT Pub. Date: Oct. 10, 2013

(65) Prior Publication Data

US 2015/0027388 A1 Jan. 29, 2015

(30) Foreign Application Priority Data

Apr. 4, 2012 (JP) ..... 2012-085836

(51) Int. Cl.

| | |
|---|---|
| ***F01P 3/08*** | (2006.01) |
| ***F01M 1/08*** | (2006.01) |
| ***F01P 3/06*** | (2006.01) |
| *F01P 3/00* | (2006.01) |

(52) U.S. Cl.

CPC .. *F01P 3/08* (2013.01); *F01M 1/08* (2013.01); *F01P 3/06* (2013.01); *F01P 2003/006* (2013.01)

(58) Field of Classification Search

CPC ..... F01M 1/08; F01P 3/06; F01P 3/08
USPC ..... 123/193.6, 41.31, 41.44, 41.45, 188.4, 123/188.9, 196 R; 239/569, 575, 583; 137/528, 538, 625.26, 625.67, 625.68, 137/625.37, 625.38

See application file for complete search history.

(56) References Cited

U.S. PATENT DOCUMENTS

| | | | | |
|---|---|---|---|---|
| 3,894,556 | A * | 7/1975 | Pareja | 137/539 |
| 6,672,262 | B2 * | 1/2004 | Bontaz | 123/41.35 |

(Continued)

FOREIGN PATENT DOCUMENTS

| | | |
|---|---|---|
| DE | 833 880 | 3/1952 |
| EP | 0 682 175 | 11/1995 |

(Continued)

OTHER PUBLICATIONS

International Search Report Issued May 28, 2013 in PCT/JP13/054495 Filed Feb. 22, 2013.

*Primary Examiner* — Lindsay Low
*Assistant Examiner* — Grant Moubry
(74) *Attorney, Agent, or Firm* — Oblon, McClelland, Maier & Neustadt, L.L.P.

(57) ABSTRACT

A body of an oil jet including: an oil supply port which opens into an oil passage in a cylinder block of an internal combustion engine; a cylinder one end of which is communicated with the oil supply port and the other end of which is closed; and an oil injection port which opens on a side surface of the cylinder. A piston valve is accommodated in the cylinder. The piston valve forms in the cylinder a differential pressure room which is a closed compartment. Moreover, an orifice which makes the differential pressure room being communicated with a side of the oil supply port is formed in the piston valve. The piston valve is biased toward a position at which the oil injection port is closed by a spring. Furthermore, a leak hole which allows oil to be leaked outside of the body from the differential pressure room is formed in the body.

9 Claims, 5 Drawing Sheets

(56) References Cited

U.S. PATENT DOCUMENTS

| | | | | |
|---|---|---|---|---|
| 7,559,296 | B2 * | 7/2009 | Perotto | 123/41.35 |
| 2014/0091161 | A1 * | 4/2014 | Yamaguchi et al. | 239/575 |

FOREIGN PATENT DOCUMENTS

| | | |
|---|---|---|
| JP | 62 167819 | 10/1987 |
| JP | 62167819 | * 10/1987 |
| JP | 5 52225 | 7/1993 |
| JP | 6 42346 | 2/1994 |
| JP | 11 22813 | 1/1999 |
| JP | 2005 76627 | 3/2005 |
| JP | 2011 12650 | 1/2011 |
| JP | 2011 64155 | 3/2011 |

* cited by examiner

| Operational range | Oil temp | Engine speed | Leak amount | Oil P *1 | Valve opening P | Oil P (Oil passage) | Injection |
|---|---|---|---|---|---|---|---|
| (1) | Low | Low | Small | High | High | Low | No |
| (2) | Low | High | Small | High | High | High *2 | Yes |
| (3) | High | Low | Large | Low | Low | Low *3 | No |
| (4) | High | High | Large | Low | Low | High | Yes |

*1:Differential pressure room, *2:Higher than valve opening pressure, *3:Lower than valve opening pressure

OIL JET

TECHNICAL FIELD

The present invention relates to an oil jet that is used for cooling a piston of an internal combustion engine.

BACKGROUND ART

In a cylinder block of an internal combustion engine, an oil passage through which oil that is pressurized flows is formed. An oil jet is an apparatus which injects oil supplied from the oil passage, to a piston or a gap between the piston and a cylinder bore, and which thereby cools the piston that has become high in temperature. A conventional oil jet generally used has a mechanism for opening and closing its valve in accordance with oil pressure. Specifically, a body of the valve is biased in a direction acting against the oil pressure by a spring, and the valve is configured to open as a result of the body of the valve separating from a valve seat when a force of oil pressure acting on the body of the valve exceeds the force of the spring. The oil pressure increases with an increase in the revolution speed of the internal combustion engine, whereas because the temperature of the piston increases with an increase in the revolution speed, the above described mechanism can cool the piston by injecting oil in a situation in which the temperature of the piston becomes high and prevent the piston from being excessively cooled by stopping the injection of oil in a situation in which the temperature of the piston is not high.

An oil jet disclosed in the following Patent Document 1 also has a mechanism for opening and closing its valve in accordance with oil pressure. This oil jet has a further mechanism for changing the injection amount of oil in accordance with oil temperature. The mechanism corresponds to a throttle member that is disposed upstream of the valve. A plurality of throttle holes are formed in the throttle member. Fluid resistance of oil acts when passing through these throttle holes, and the magnitude thereof increases with an increase in the viscosity of the oil. Because of this, the flow rate of the oil passing through the throttle holes becomes smaller when the temperature of the oil is low and the viscosity of the oil is high, whereas the flow rate of the oil passing through the throttle holes becomes larger when the temperature of the oil is high and the viscosity of the oil is low. According to such mechanism, when the valve is opened in association with an increase in oil pressure, the injection amount of oil is suppressed because of low oil temperature if it is during the cold condition immediately after an engine start up, whereas the injection amount of oil is increased in association with an increase in oil temperature if it is after completion of a warm up.

In addition, another oil jet is proposed which has a mechanism for opening and closing its valve in accordance with oil temperature as well as a mechanism for opening and closing the valve in accordance with oil pressure. An oil jet disclosed in the following Patent Document 2 has a first mechanism for opening and closing its valve with a normal spring and a second mechanism for opening and closing its valve with a spring made of a shape-memory alloy. According to the first mechanism having the normal spring, the valve is opened when a force of oil pressure acting on a body of the valve exceeds the force of the spring. On the other hand, according to the second mechanism having the spring made of a shape-memory alloy, the valve becomes closed during the cold condition in which the spring is compressed, whereas the valve becomes opened during the warm condition in which the spring is restored to expand. With such mechanisms, both valves are opened to inject oil only when the oil pressure is high and the oil temperature is high.

Alternatively, an oil jet, as with, for example, an oil jet disclosed in the following Patent Document 3, is proposed which can electrically control the execution and stopping of oil injection by driving a body of its valve using a solenoid.

CITATION LIST

Patent Documents

Patent Document 1: Japanese Laid-open Patent Application Publication No. 2011-064155
Patent Document 2: Japanese Laid-open Patent Application Publication No. 2011-012650
Patent Document 3: Japanese Laid-open Patent Application Publication No. Hei 06-042346

SUMMARY OF INVENTION

Technical Problem

Each of the oil jets disclosed in Patent Documents 1 and 2 is configured such that the operational state is changed depending on oil temperature as well as oil pressure. The oil temperature is closely related to the temperature state of the piston as well as the oil pressure, and therefore, according to the configuration in which the operational state of the oil jet is changed also depending on the oil temperature, it is conceivable that the piston could be cooled more properly with the injection of oil, compared with a general oil jet by which its valve is opened and closed simply in accordance with the oil pressure.

However, each of the oil jets disclosed in Patent Documents 1 and 2 is problematic as described later.

Since the oil jet disclosed in Patent Document 1 includes the throttle member disposed in a flow passage of oil, pressure loss is produced when oil passes through the throttle member. Although the pressure loss produced becomes smaller if the viscosity of oil decreases as a result of an increase in the oil temperature, the pressure loss is larger than that of an oil jet which does not include the throttle member. The amount of oil injected to the piston at the time of high temperature is decreased by an amount corresponding to the pressure loss. Further, since the injection amount of oil is suppressed until the oil temperature is sufficiently increased even if the oil pressure rises, there is a concern that in a case like when the internal combustion engine during the cold condition is operated at high engine speed, a sufficient amount of oil may not be injected even though the temperature of the piston is high.

According to the oil jet disclosed in Patent Document 2, oil is not injected until the valves of both of the first mechanism for opening and closing its valve with the normal spring and the second mechanism for opening and closing its valve with the spring made of a shape-memory alloy is opened. Because of this, in a case in which the oil temperature is low but the oil pressure is high, such as a case in which the internal combustion during the cold condition is operated at high engine speed, the oil can not be injected in spite of a thermally severe condition due to an increase in the piston temperature.

The problem described so far can be solved by changing, in accordance with the oil temperature, a valve opening pressure when a valve is opened. That is to say, a problem that each of the oil jets disclosed in Patent Documents 1 and 2 has would not occur, if the valve opening pressure could increase when the oil temperature is low, and if the valve opening pressure could decrease with an increase in the oil temperature. However, it is preferable that the valve opening pressure be self-regulated mechanically instead of electrically operating the opening and closing of the valve as in the oil jet disclosed in Patent Document 3. This is because it has an advantage in terms of reliability and cost.

The present invention has been made to solve the problem as described above, and has its object to provide an oil jet in which a valve opening pressure is self-regulated mechanically in accordance with oil temperature.

Solution to Problem

An oil jet according to the present invention includes at least a body, a piston valve and a spring. The body is a main body part of the oil jet attached to a cylinder block of an internal combustion engine, and has an oil supply port, a cylinder and an oil injection port. The oil supply port is formed so as to open into an oil passage in the cylinder block in a state in which the body is attached to the cylinder block. One end of the cylinder is communicated with the oil supply port, and another end thereof is closed. The oil injection port opens on a side surface of the cylinder, and can be connected with an oil injection nozzle for adjusting a direction of oil injection. The piston valve is accommodated in the cylinder and forms a closed compartment in the cylinder. In the piston valve, an orifice which makes the closed compartment being communicated with a side of the oil supply port is formed. The spring biases the piston valve toward a position at which the oil injection port is closed. Further, in the oil jet according to the present invention, a leak hole which allows oil to be leaked outside of the body from the closed compartment is formed in the body.

According to the above described configuration which the oil jet in the present invention includes, the oil injection port is opened and closed by the piston valve. On the piston valve, the pressure of oil flowing through the oil passage in the cylinder block acts, and at the same time, the pressure of oil in the closed compartment and a biasing force by the spring act in a direction opposite to this. Further, when a force of the oil pressure in the oil passage acting on the piston valve has become greater than the total force of a force of the oil pressure in the closed compartment acting on the piston valve and the biasing force of the spring, the piston valve is pushed by the oil supplied from the oil passage to move from a position which covers the oil injection port. This allows the piston valve to be in the opened state so that the oil injection port is communicated with the oil supply port, and allows oil to be supplied to the oil injection port so that oil injection is achieved.

The oil pressure in the closed compartment varies in accordance with a relation between the flow rate of oil flowing into the closed compartment through the orifice and the flow rate of oil leaking from the closed compartment through the leak hole. In the oil jet according to the present invention, there is a difference between the orifice and the leak hole in a factor for determining their flow rates. In the orifice in which a relation between flow rate and pressure is based on Bernoulli's theorem, oil density determines the flow rate. More specifically, the flow rate of the oil passing through the orifice to flow into the closed compartment from the oil injection port side is inversely proportional to the one-second power of the oil density. On the other hand, in the leak hole in which flow rate is determined based on Hagen-Poiseuille law, oil viscosity determines the flow rate. More specifically, the flow rate of the oil passing through the leak hole to leak outside the body from the closed compartment in the cylinder is inversely proportional to the oil viscosity. Here, an important thing is that there is a large difference in the sensitivities thereof with respect to the oil temperature between the oil density and the oil viscosity. The oil density changes little with respect to a change in the oil temperature, and the oil density can be recognized as being nearly constant in a normal temperature range of oil in an internal combustion engine. In contrast to this, the oil viscosity changes quite greatly with respect to a change in the oil temperature. Although depending on oil types, the oil viscosity during the cold time is more than ten times the oil viscosity after warm up. Because of this, when compared at the same pressure in the closed compartment, although the flow rate of the oil which flows into the closed compartment from the orifice does not change greatly depending on the oil temperature, the flow rate of the oil which is leaked from the leak hole increases with an increase in the oil temperature. As the flow rate of the oil which is leaked from the leak hole becomes larger, the oil pressure in the closed compartment becomes lower.

Since a biasing force of the spring is constant, an oil pressure in the oil passage that is required to move the piston valve, that is to say, a valve opening pressure is determined depending on the oil pressure in the closed compartment. In a situation in which the oil temperature is high, such as a time after completion of warm up, oil is easy to be leaked from the closed compartment because the oil viscosity is low, and as a result, the valve opening pressure becomes low because the pressure in the closed compartment becomes low. On the other hand, in a situation in which the oil temperature is low, such as the cold time, oil is hard to be leaked from the closed compartment because the oil viscosity is high, and as a result, the valve opening pressure becomes high because the pressure in the closed compartment becomes high. In fact, according to the above described configuration which the oil jet of the present invention includes, the valve opening pressure is self-regulated mechanically so that the valve opening pressure becomes lower with an increase in the oil temperature and the valve opening pressure becomes higher with a decrease in the oil temperature.

Various shapes can be adopted as a shape of the leak hole. In a case in which the oil jet is provided with a column-shaped stopper that is inserted into the closed compartment from a bottom part of the cylinder and limits a moving range of the piston valve, the leak hole can be configured by a gap that is formed between a hole formed in the body to pass the stopper and a side surface of the stopper. The shape of the leak hole in this case can be formed as an annular gap surrounding the stopper. Moreover, as the leak hole, a slender hole through which a top surface or a side surface of the stopper is communicated with an outer surface of the body can be formed. Furthermore, as the leak hole, a slender hole or a slit through which a bottom surface or a side surface of the cylinder is communicated with an outer surface of the body can be formed.

Advantageous Effects of Invention

As described above, the oil jet according to the present invention can self-regulate a valve opening pressure mechanically in accordance with oil temperature.

DESCRIPTION OF EMBODIMENTS

First Embodiment

Hereinafter, a first embodiment of the present invention will be described with reference to Figures.

Figure 1:
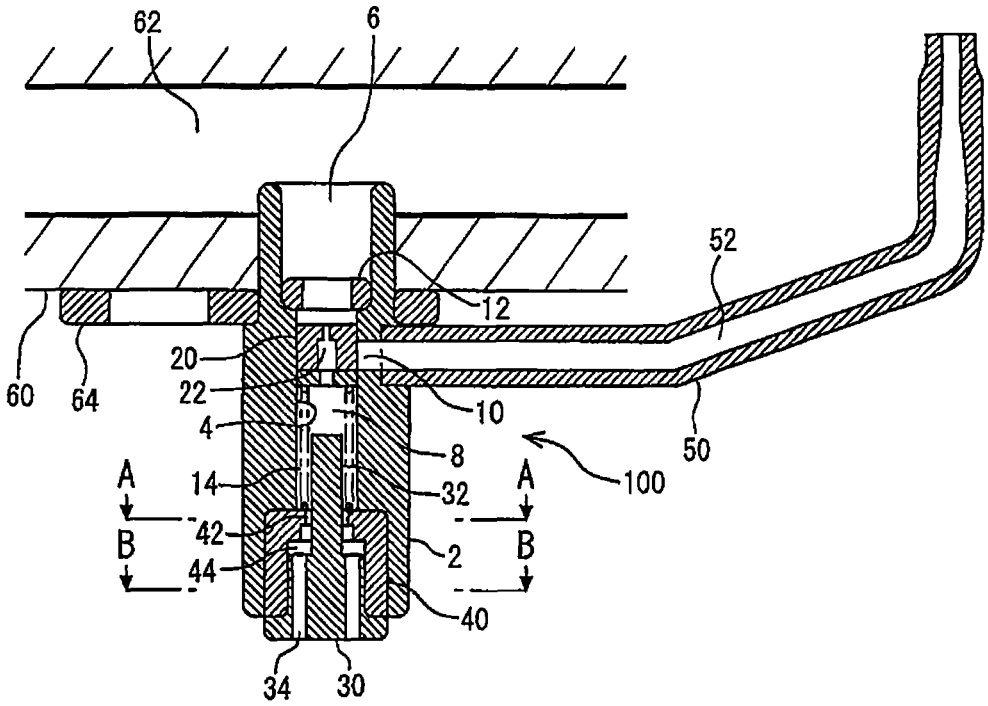
FIG. 1 is a longitudinal cross-sectional view which represents a configuration of an oil jet according to a first embodiment of the present invention.
Figure 2:
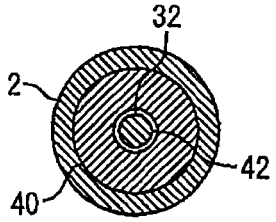
FIG. 2 is a cross-sectional view taken along the line A-A in FIG. 1.
Figure 3:
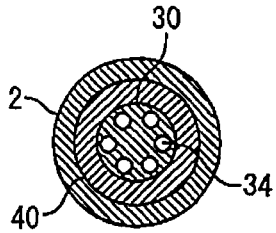
FIG. 3 is a cross-sectional view taken along the line B-B in FIG. 1.

A configuration of an oil jet according to the first embodiment of the present invention can be explained using FIGS. 1 to 3. As shown by the longitudinal sectional view of FIG. 1, an oil jet 100 according to the present embodiment includes a body 2 attached to a cylinder block 60 of an internal combustion engine. The attachment of the body 2 to the cylinder block 60 is made via a plate 64. In the cylinder block 60, an oil passage 62 through which oil pressurized by an oil pump flows is formed. Since the oil pump is driven by a power received from a crankshaft of the internal combustion engine, the oil pressure inside the oil passage 62 is low when the engine speed is low, and the oil pressure inside the oil passage 62 increases with an increase in the engine speed. In the body 2, an oil supply port 6 which opens into this oil passage 62 is formed.

In the body 2, a cylinder 4 an inlet of which is the oil supply port 6 is formed. The diameter of the cylinder 4 is made smaller than that of the oil supply port 6. Although the cylinder 4 is formed so as to penetrate the body 2, the outlet is covered by a holder 40 described later. In this way, a room, one end of which is opened and the other end of which is closed, is formed in the cylinder 4. An oil injection port 10 the diameter of which is smaller than that of the cylinder 4 opens on a side surface of the cylinder 4 in the vicinity of the inlet thereof. An oil injection nozzle 50 is joined to the body 2 by brazing or the like, and an oil injection passage 52 formed inside the oil injection nozzle 50 is communicated with the oil injection port 10. The distal end of the oil injection nozzle 50 is directed toward the rear surface of a piston of the internal combustion engine, or a gap between the piston and a cylinder bore. In this connection, although only one oil injection nozzle 50 is shown in FIG. 1, a plurality of oil injection nozzles 50 can be alternatively attached to the body 2 by forming a plurality of oil injection ports 10 in the circumferential direction of the cylinder 4.

In the cylinder 4, a piston valve 20 and a spring 14 are accommodated. An annular collar 12 for encapsulating the piston valve 20 and the spring 14 in the cylinder 4 is attached to the inlet of the cylinder 4. The diameter of the collar 12 is substantially the same as that of the oil supply port 6, and the collar 12 is implanted with extension to the inlet of the cylinder 4 by press-fit. The spring 14 is a compression coil spring and disposed between the piston valve 20 and the bottom surface of the cylinder 4. The length of the spring 14 is adjusted such that the piston valve 20 comes into a position to cover the oil injection port 10 in a state in which no oil pressure acts on to the piston valve 20.

In addition, in the cylinder 4, a stopper 32 for limiting a moving range of the piston 20 is provided. The stopper 32 has a circular cylindrical shape and is protruded into the cylinder 4 from the bottom part of the cylinder 4. The bottom part of the cylinder 4 is formed using the holder 40 implanted in the body 2. A plug 30 that is integrated with the stopper 32 is fitted into the holder 40, and the stopper 32 is inserted into the cylinder 4 through a hole formed in the holder 40. Although the holder 40 and the plug 30 are provided separately from the body 2, these can be recognized as a part of the body 2.

There is formed inside the cylinder 4, a closed compartment 8 that is surrounded by the piston valve 20 and the side surface and bottom surface of the cylinder 4. There is formed in the piston valve 20, an orifice 22 which makes the closed compartment 8 being communicated with the side of the oil supply port 6. Because of this, in a situation in which the oil jet 100 is attached to the cylinder block 60, the closed compartment 8 is filled up with oil via the orifice 22. In this regard, according to the configuration described later, a differential pressure with respect to the oil pressure in the oil passage 62 is produced concerning the oil pressure in the closed compartment 8. Hereinafter, this closed compartment 8 is referred to as a differential pressure room.

Although the bottom part of the differential pressure room 8 is formed using the holder 40, a hole for inserting the stopper 32 into the differential pressure room 8 is opened in the holder 40. A small gap 42 is arranged between the hole and the peripheral surface of the stopper 32. To be more specific, an annular gap 42 surrounding the stopper 32 is arranged as shown in FIG. 2. This annular gap 42 is provided to leak the oil in the closed compartment 8 outside the body 2, and the flow passage sectional area thereof is formed much smaller than the sectional area of the closed compartment 8. Hereinafter, this annular gap is referred to as a leak hole 42. Forming such leak hole 42 in the body 2 causes oil to be leaked outside the body 2 from the differential pressure room 8, and thereby, the oil pressure in the closed compartment 8 is decreased. That is to say, a differential pressure is produced between the oil pressure in the oil passage 62 and the oil pressure in the closed compartment 8.

There is formed between the holder 40 and the plug 30, an oil discharge room 44 for discharging, outside, the oil that is leaked from the leak hole 42. The oil discharge room 44 is communicated with the outside of the body 2 through a plurality of oil discharge holes 34 formed in the plug 30. As evidenced by comparing FIG. 2 with FIG. 3, the total flow passage sectional area of the oil discharge holes 34 is much larger than the flow passage sectional area of the leak hole 42. Because of this, the oil leaked from the leak hole 42 into the oil discharge room 44 is promptly discharged outside the body 2 through the oil discharge holes 34 without permeating the oil discharge room 44 or the oil discharge holes 34.

Figure 4:
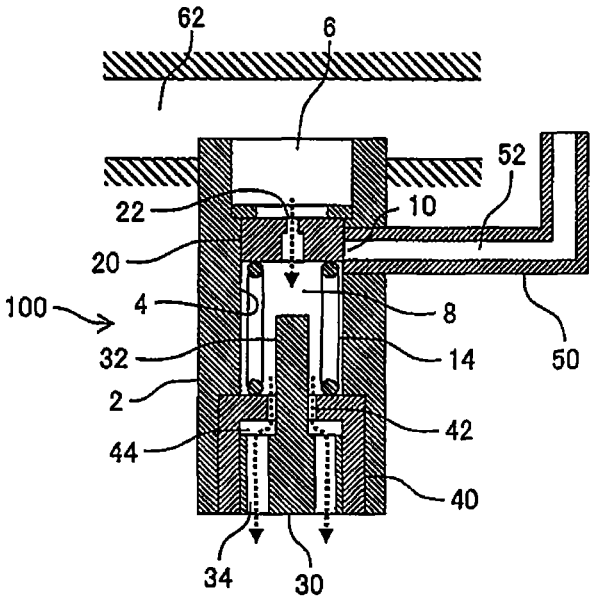
FIG. 4 is a longitudinal cross-sectional view which exemplarily represents a state at the time of closing of the oil jet according to the first embodiment of the present invention.

Next, the operation of the oil jet 100 according to the present embodiment will be described with reference to FIGS. 4 and 5.

According to the configuration of the oil jet 100 in the present embodiment, the hydraulic pressure of the oil flowing through the oil passage 62 acts on the piston valve 20 from the oil supply port 6 side. In addition, at the same time, the oil pressure in the differential pressure room 8 and a biasing force of the spring 14 act on the piston valve 20 in the opposite direction. The former acts on the piston valve 20 as a force in the valve opening direction, and the latter acts as a force in the valve closing direction. Consequently, if the total force of a force due to the oil pressure in the differential pressure room 8 and a biasing force of the spring 14 is greater than or equal to a force due to the oil pressure in the oil passage 62, the piston valve 20 is held at a position that covers the oil injection port 10 as shown in the exemplary diagram in FIG. 4. That is to say, the piston valve 20 is maintained in the closed state.

Figure 5:
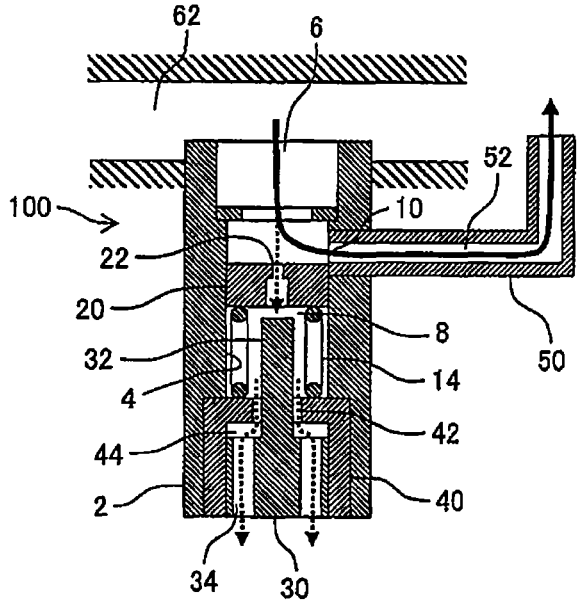
FIG. 5 is a longitudinal cross-sectional view which exemplarily represents a state at the time of opening of the oil jet according to the first embodiment of the present invention.

If, on the other hand, a force due to the oil pressure in the oil passage 62 is greater than the total force of a force due to the oil pressure in the differential pressure room 8 and a biasing force of the spring 14, the piston valve 20 is pushed by the oil supplied from the oil passage 62 to move from the position that covers the oil injection port 10 as shown in the exemplary diagram in FIG. 5. This allows the piston valve 20 to be in the opened state so that the oil injection port 10 is communicated with the oil supply port 6, and allows oil to be supplied to the oil injection port 10 so that oil injection by use of the oil injection nozzle 50 is achieved. FIGS. 4 and 5 show the flow of oil in the oil jet 100 with arrowed lines.

Since a biasing force of the spring 14 is constant when the position of the piston valve 20 is constant, an oil pressure in the oil passage 62 that is required to open the piston valve 20 is determined depending on the oil pressure in the differential pressure room 8. The oil pressure in the differential pressure room 8 varies with a relation between the flow rate of the oil which enters into the differential pressure room 8 and the flow rate of the oil which is discharged from the differential pressure room 8. Since oil flows into the differential pressure room 8 through the orifice 22, the flow rate Q1 thereof is based on Bernoulli's theorem as represented by the following equation 1. More specifically, the flow rate Q1 of the oil passing through the orifice 22 is proportional to the one-second power of the differential pressure between the oil pressure $P_{M/G}$ in the oil passage 62 and the oil pressure $P_{IN}$ in the differential pressure room 8, and inversely proportional to the one-second power of oil density ρ. Concerning the equation 1, "C" denotes a flow coefficient, and "A" denotes the flow passage sectional area of the orifice 22.

[Equation 1]

$$Q1 = C \times A \times \sqrt{\frac{2(P_{MIG} - P_{IN})}{\rho}} \qquad \text{Equation 1}$$

On the other hand, since oil is leaked through the leak hole 42 from the differential pressure room 8, the flow rate Q2 thereof is based on Hagen-Poiseuille law as represented by the following equation 2. More specifically, the flow rate Q2 of the oil passing through the leak hole 42 is proportional to the differential pressure between the oil pressure $P_{IN}$ in the differential pressure room 8 and the atmospheric pressure $P_{OUT}$, and inversely proportional to oil viscosity η. Concerning the equation 2, "B" denotes a coefficient.

[Equation 2]

$$Q2 = (P_{IN} - P_{OUT}) \times \frac{\pi}{12\eta} \times B \qquad \text{Equation 2}$$

As evidenced from the above described two equations, the flow rate of the oil passing through the orifice 22 is affected by the oil density, whereas the flow rate of the oil passing through the leak hole 42 is affected by the oil viscosity. Although the oil density and the oil viscosity are both affected by the oil temperature, the sensitivities thereof greatly differ from each other. Specifically, the oil density changes little with respect to a change in the oil temperature, and the oil density is nearly constant at a temperature range during a period from the cold time to a warm-up completion time. In contrast to this, the oil viscosity changes quite greatly with respect to a change in the oil temperature, and the oil viscosity during the cold time is about twenty times as high as the oil viscosity after the warm up.

Due to each characteristic of the oil density and oil viscosity with respect to the oil temperature as above, although the flow rate of the oil which flows into the differential pressure room 8 from the orifice 22 does not change greatly depending on the oil temperature, the flow rate of the oil which is leaked from the leak hole 42 increases with an increase in the oil temperature. As the flow rate of the oil which is leaked from the leak hole 42 becomes larger, the oil pressure in the differential pressure room 8 becomes lower, and thereby, an oil pressure in the oil passage 62 required to open the piston valve 20, that is to say, a valve opening pressure becomes lower. Consequently, in a case in which the oil temperature is high, such as a time after completion of warm up, the valve opening pressure becomes low because the oil is easy to be leaked from the leak hole 42, whereas in a case in which the oil temperature is low, such as the cold time, the valve opening pressure becomes high because the oil is hard to be leaked from the leak hole 42.

Figures 6, 7:
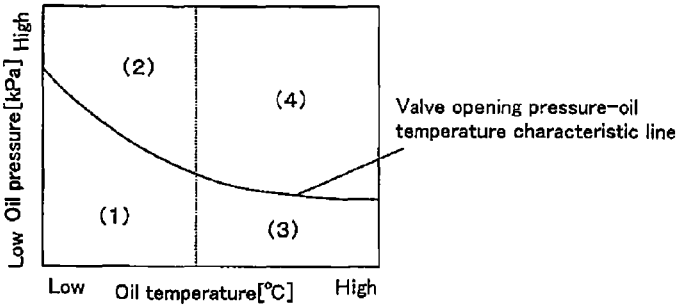
FIG. 6 is a graph which exemplarily represents characteristics of a valve opening pressure with respect to oil temperature of the oil jet according to the first embodiment of the present invention.
FIG. 7 is a table collectively showing operational states in the respective ranges in FIG. 6.

FIG. 6 shows a graph that represents a valve opening pressure-oil temperature characteristics of the oil jet 100 according to the present embodiment, and its longitudinal axis is the oil pressure and its horizontal axis is the oil temperature. According to the oil jet 100 of the present embodiment, the valve opening pressure is self-regulated mechanically so as to be lower with an increase in the oil temperature and so as to be higher with a decrease in the oil temperature, as shown in the graph. In the graph shown in FIG. 6, the operational range of the oil jet 100 is divided into four ranges according to the oil temperature and oil pressure. Hereinafter, the operation of the oil jet 100 in each operational range and the effects thereof will be described with reference to a table shown in FIG. 7.

The operational range (1) is a low-oil-temperature and low-oil-pressure range. This can be also said to be a low-oil-temperature and low-engine-speed range since the oil pressure changes in accordance with the engine speed. The oil viscosity is high at the time of low oil temperature, and therefore, the oil that has passed through the orifice 22 to flow into the differential pressure room 8 is hard to be leaked from the leak hole 42. Accordingly, the oil pressure in the differential pressure room 8 becomes high, and the valve opening pressure of the piston valve 20 becomes high. Hence, the piston valve 20 is not opened in a low engine speed range during which the oil pressure in the oil passage 62 is low, and no oil injection by the oil jet 100 is performed. An internal combustion engine in the operational range (1) does not need cooling by the oil because the temperature of a piston in the internal combustion engine is low. Instead a stopping of oil injection can prevent the piston from being excessively cooled.

The operational range (2) is a low-oil-temperature and high-oil-pressure range, that is to say, a low-oil-temperature and high-engine-speed range. A situation in which an internal combustion engine in a cold state is operated at high engine speed is included in this range, and the temperature of a piston rises to a level which needs cooling. According to the oil jet 100 of the present embodiment, in this operational range (2), the piston valve 20 is opened when the oil pressure in the oil passage 62 exceeds a valve opening pressure, and thereby, oil injection by the oil jet 100 is performed. This allows a piston that has become high in temperature to effectively be cooled.

The operational range (3) is a high-oil-temperature and low-oil-pressure range, that is to say, a high-oil-temperature and low-engine-speed range. The oil viscosity is low at the time of high oil temperature, and therefore, the oil that has passed through the orifice 22 to flow into the differential pressure room 8 is easy to be leaked from the leak hole 42. Accordingly, the oil pressure in the differential pressure room 8 becomes low, and the valve opening pressure of the piston valve 20 becomes low. The piston valve 20, however, is not opened because the oil pressure in the oil passage 62 is also low in a low engine speed range, and no oil injection by the oil jet 100 is performed. When an internal combustion engine is in the operational range (3), although the oil temperature is high, the temperature of a piston does not rise so much because the engine speed is low. Consequently, cooling of the piston by the oil is not needed, and a stopping of oil injection can prevent the piston from being excessively cooled instead.

The operational range (4) is a high-oil-temperature and high-oil-pressure range. In this operational range (4), the oil pressure in the oil passage 62 becomes high, whereas a valve opening pressure of the piston valve 20 becomes low because oil becomes easy to be leaked from the leak hole 42 due to a decrease in oil viscosity. Because of this, the piston valve 20 is easily opened to perform oil injection by the oil jet 100, and thereby, a piston that has become high in temperature is effectively cooled.

As described so far, the oil jet 100 according to the present embodiment can surely perform oil injection in operational ranges which needs cooling of a piston of an internal combustion engine, and surely stop oil injection in operational ranges which does not need cooling of the piston. Further, according to the oil jet 100 of the present embodiment, oil injection which is needed can be surely performed, even if a failure should occur, specifically, even if the spring 14 for moving the piston valve 20 should be broken. Since the spring 14 is biasing the piston valve 20 in a direction blocking the valve opening, a biasing force thereof disappears when the spring 14 has been broken, and thereby, the piston valve 20 is opened at a lower oil pressure. This allows oil injection with respect to a piston to be surely performed, and therefore, an occurrence of troubles, such as seizure of the piston, due to a failure of the oil jet 100 is prevented.

Second Embodiment

Next, a second embodiment of the present invention will be described with reference to Figures.

Figure 8:
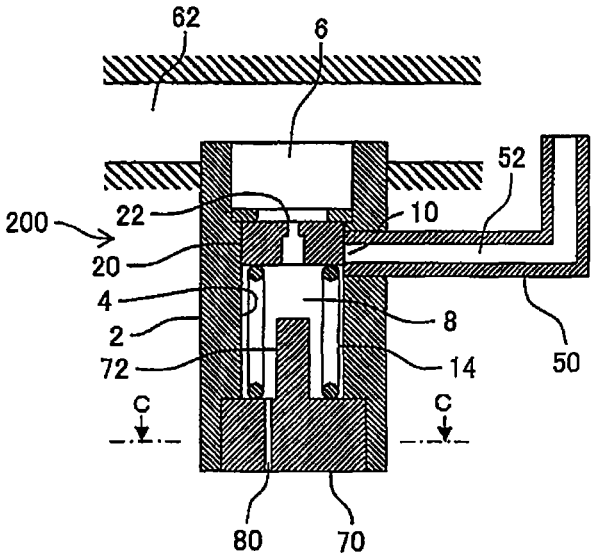
FIG. 8 is a longitudinal cross-sectional view which exemplarily represents a configuration of an oil jet according to a second embodiment of the present invention.
Figure 9:
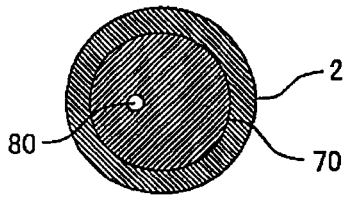
FIG. 9 is a cross-sectional view taken along the line C-C in FIG. 8.

A configuration of an oil jet 200 according to the second embodiment of the present invention can be explained using FIGS. 8 and 9. In FIGS. 8 and 9, elements having the same configuration or function as that of the oil jet 100 according to the first embodiment shown in FIG. 1 are given the same reference characters. The difference between the oil jet 200 of the present embodiment and the oil jet 100 of the first embodiment is the shape of a leak hole for leaking oil outside the body 2 from the differential pressure room 8. In the oil jet 200 according to the present embodiment, a slender hole through which the bottom surface of the cylinder 4 is communicated with the outer surface of the body 2 is formed, and it functions as a leak hole 80, as shown in FIGS. 8 and 9. The flow passage sectional area of the leak hole 80 is formed much smaller than the sectional area of the closed compartment 8. The flow rate of the oil which is leaked from the leak hole 80 formed in this manner is inversely proportional to the oil viscosity as represented by the foregoing equation 2. In the oil jet 200 according to the present embodiment, a plug 70 that is integrated with a stopper 72 is fitted at the outlet of the cylinder 4 that is formed in the body 2, and the bottom part of the cylinder 4 is formed by the plug 70.

The flow rate of the oil which is leaked from the leak hole 80, a slender hole, is small when the oil temperature is low, whereas it is large when the oil temperature is high. Because of this, the oil pressure in the differential pressure room 8 becomes higher and a valve opening pressure also becomes higher as the oil temperature is lower, whereas the oil pressure in the differential pressure room 8 becomes lower and the valve opening pressure also becomes lower as the oil temperature is higher. In fact, according to the oil jet 200 of the present embodiment, the valve opening pressure is self-regulated mechanically depending on the oil temperature, as with the first embodiment 1.

Alternatives

Although embodiments of the present invention have been described so far, the present invention is not limited to the above described embodiments, and various modifications of the present invention can be made without departing from the scope and spirit of the present invention. For example, the following modifications can be made.

Figure 10:
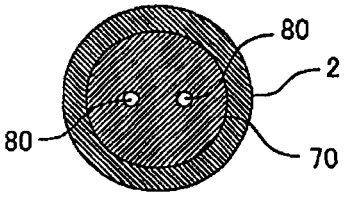
FIG. 10 is a view which corresponds to the cross-sectional view taken along the line C-C in FIG. 8 and represents a variation example of the number of leak holes.

In the second embodiment, the number of the leak holes 80 which are slender holes is not limited to one. For example, two leak holes 80 may be formed as shown in FIG. 10, or more numbers of the leak holes 80 may be formed. The number of the leak holes 80 may be determined so that intended valve opening pressure-oil temperature characteristics are obtained with taking into consideration the flow passage sectional area of the orifice 22, the volume of the differential pressure room 8, or the like.

Figure 11:
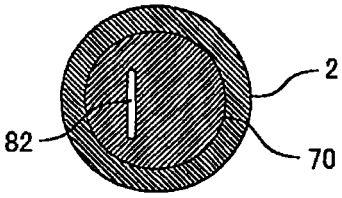
FIG. 11 is a view which corresponds to the cross-sectional view taken along the line C-C in FIG. 8 and represents a variation example of the shape of a leak hole.

The shape of the leak hole in the second embodiment can be also changed from a slender hole to a slit. More specifically, a slit as shown in FIG. 11 can be also used as a leak hole 82. Even if such slit-like leak hole 82 is used, the flow rate of the oil which is leaked from the leak hole 82 can be arbitrarily adjusted by setting the length or width of the slit. In addition, the slit-like leak holes 82 can be also formed plurally, as with a slender leak hole.

Figure 12:
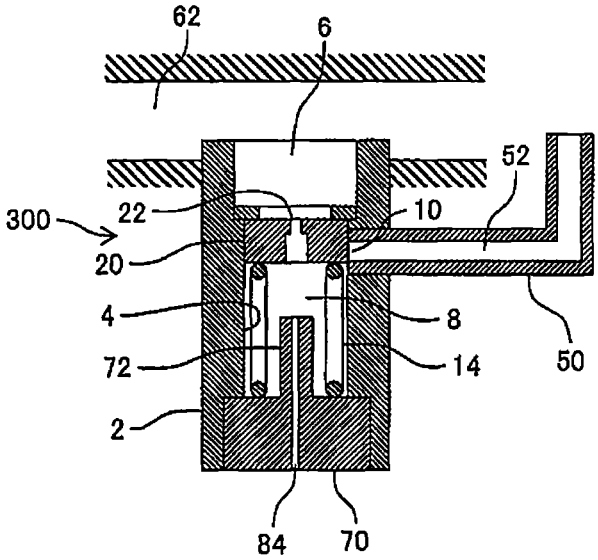
FIG. 12 is a view which corresponds to FIG. 8 and represents a variation example of the position at which a leak hole is formed.
Figure 13:
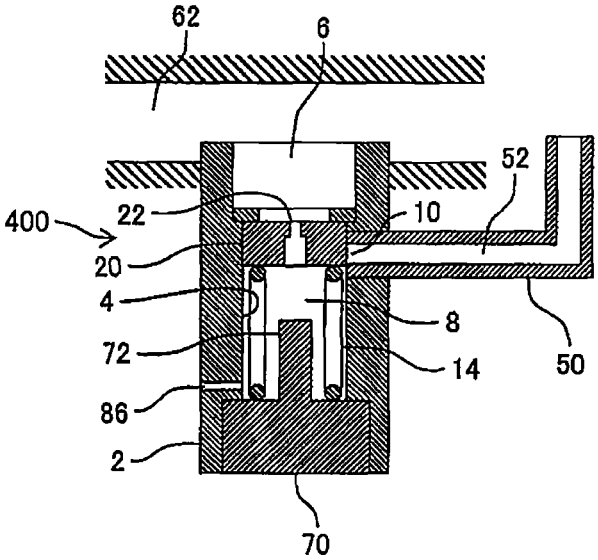
FIG. 13 is a view which corresponds to FIG. 8 and represents a variation example of the position at which a leak hole is formed.

Moreover, the position of the leak hole in the second embodiment can be shifted to another position from the bottom surface of the cylinder 4. For example, as in an oil jet 300 shown in FIG. 12, a leak hole 84 through which the top surface of the stopper 72 is communicated with the outer surface of the body 2 can be formed. The leak hole 84 in this case is preferably formed as a slender hole. Furthermore, as in an oil jet 400 shown in FIG. 13, a leak hole 86 through which the side surface of the cylinder 4 is communicated with the outer surface of the body 2 can be formed. The leak hole 86 in this case may be formed as a slender hole or a slit.

DESCRIPTION OF SYMBOLS

2 body
4 cylinder
6 oil supply port
8 differential pressure room (closed compartment)
10 oil injection port
12 collar
14 spring
20 piston valve
22 orifice
30 plug
32 stopper
34 oil discharge hole
40 holder
42 leak hole (annular gap)
44 oil discharge room
50 oil injection nozzle
52 oil injection passage
60 cylinder block
62 oil passage
70 plug
72 stopper
80, 84, 86 leak hole (slender hole)
82 leak hole (slit)
100, 200, 300, 400 oil jet

The invention claimed is:

1. An oil jet, comprising:

a body that has an oil supply port which opens into an oil passage in a cylinder block of an internal combustion engine, a cylinder one end of which is communicated with the oil supply port and another end of which is closed, and an oil injection port which opens on a side surface of the cylinder;

a piston valve that is accommodated in the cylinder to form a closed compartment in the cylinder, the piston valve including an orifice that communicates the closed compartment with a side of the oil supply port; and a spring that biases the piston valve toward a position at which the oil injection port is closed, wherein a leak hole which allows oil to be leaked outside the body from the closed compartment is formed in the body.

2. The oil jet according to claim 1, further comprising:

a stopper, that is column-shaped, is inserted into the closed compartment from a bottom part of the cylinder and limits a moving range of the piston valve, wherein the leak hole is a gap formed between a hole, through which the stopper formed in the body is passed, and a side surface of the stopper.

3. The oil jet according to claim 2, wherein the gap is an annular gap surrounding the stopper.

4. The oil jet according to claim 2, wherein the stopper limits the moving range of the piston valve by contacting a surface of the piston valve when the piston valve moves toward a bottom part side.

5. The oil jet according to claim 1, further comprising:

a stopper, that is column-shaped, is protruded into the closed compartment from a bottom part of the cylinder and limits a moving range of the piston valve, wherein the leak hole is a hole that communicates a top surface of the stopper with an outer surface of the body.

6. The oil jet according to claim 5, wherein the stopper limits the moving range of the piston valve by contacting a surface of the piston valve when the piston valve moves toward a bottom part side.

7. The oil jet according to claim 1, wherein the leak hole is a hole that communicates a bottom surface or a side surface of the cylinder with an outer surface of the body.

8. The oil jet according to claim 1, wherein the leak hole is a slit that communicates a bottom surface or a side surface of the cylinder is with an outer surface of the body.

9. The oil jet according to claim 1, wherein the orifice is in an axial direction of the piston valve.

* * * * *